US006193535B1

(12) United States Patent
Ayers et al.

(10) Patent No.: US 6,193,535 B1
(45) Date of Patent: Feb. 27, 2001

(54) CONNECTOR ASSEMBLY WITH EXTREME TEMPERATURE PROTECTIVE CERAMIC DEADFACE

(75) Inventors: James E. Ayers, Newbury Park; Shohreh Sedighi, Valencia; John D. Kisch, Ventura; David J. Hernandez, Jr., Camarillo, all of CA (US)

(73) Assignee: G&H Technology, Inc., Camarillo, CA (US)

( * ) Notice: Subject to any disclaimer, the term of this patent is extended or adjusted under 35 U.S.C. 154(b) by 0 days.

(21) Appl. No.: 09/502,027

(22) Filed: Feb. 10, 2000

(51) Int. Cl.[7] ..... H01R 13/62
(52) U.S. Cl. ..... 439/258; 439/933
(58) Field of Search ..... 439/258, 935, 439/933; 174/50.53; 102/378; 89/1.14; 60/632; 148/537, 525

(56) References Cited

U.S. PATENT DOCUMENTS 4,166,664 * 9/1979 Herrmann, Jr. ..... 439/258
4,264,115 * 4/1981 Chow ..... 439/258
5,211,776 * 5/1993 Weiman ..... 148/525
5,372,071 * 12/1994 Richards et al. ..... 102/378
5,542,333 * 8/1996 Hagelgerg et al. ..... 89/1.81
5,585,596 * 12/1996 Richards et al. ..... 102/378

* cited by examiner

*Primary Examiner*—Khiem Nguyen
*Assistant Examiner*—J. F. Duverne
(74) *Attorney, Agent, or Firm*—Thomas I. Rozsa; Tony D. Chen; Jerry Fong

(57) ABSTRACT

A connector assembly which includes conventional components that are well known in the connector assembly field but which includes within it an improved ceramic deadface which is located at a front face plate on an interior portion of the connector assembly. If the connector is separated so that the deadface is exposed, then in the event that location with the deadface exposed faces an area of extreme high temperature, the deadface preserves the connector assembly and prevents internal components including plugs and wires from being destroyed or melted. The connector assembly involves the incorporation of a novel ceramic deadface on the interior portion of the connector assembly which is able to withstand extreme high temperatures.

11 Claims, 3 Drawing Sheets

CONNECTOR ASSEMBLY WITH EXTREME TEMPERATURE PROTECTIVE CERAMIC DEADFACE

BACKGROUND OF THE INVENTION

1. Field of the Invention

The present invention generally relates to the field of connector assemblies which are designed to connect electronic male or female plug members which in turn are connected to wires for systems such as computer systems, programming instruments and other electronic components which serve to program the computer at a remote location. By way of example only, the computer system to be programmed may be placed inside a rocket or missile and the system doing the programming is located in a ground based facility and the connector and wires are designed to connect the ground based programming facility to the onboard computer prior to liftoff.

2. Description of the Prior Art

In general, connector assemblies have been known in the art and have been extensively used. However, the vast majority of connector assemblies are not designed to withstand very extreme temperatures and as a result, in the event they are subjected to very extreme temperatures, the extreme high temperatures cause the connector assemblies to melt or otherwise destroy the internal components that are housed within the connector assembly. In the past, an interior portion of the connector assembly known as the deadface have been made out of polymers or fiber reinforced polymers. However, it has been discovered that the fiber reinforced polymers are not able to withstand extreme high temperatures and as a result, if the deadface is exposed, they melt and cause destruction of the male and female connector components as well as the wire leads that are being connected through the connector assembly from the ground based computer system to the onboard computer system. It is therefore desirable to have an improved deadface portion of the connector assembly which is able to substantially withstand exposure to extreme high temperatures if the deadface is exposed.

SUMMARY OF THE INVENTION

The present invention is a connector assembly which comprises conventional components that are well known in the connector assembly field but which includes within it an improved ceramic deadface which is located at a front face plate on an interior portion of the connector assembly. If the connector assembly is separated so that the deadface is exposed, then in the event that location with the deadface exposed faces an area of extreme high temperature, the deadface preserves the connector assembly and prevents internal components including plugs and wires from being destroyed or melted. The present invention involves the incorporation of a novel ceramic deadface on the interior portion of the connector assembly which is able to withstand extreme high temperatures.

It is an object of the present invention to provide a connector assembly which can be used at the lower base location of a missile or rocket which is located adjacent to the nozzle where the rocket exhausts are emitted upon takeoff. The connector assembly comprises two parts which are separated upon takeoff wherein a portion of the connector assembly remains affixed to the ground which might be a structure adjacent to a rocket or possibly a missile silo which might have housed the missile, and another portion of the connector assembly which is affixed to the lower portion of the rocket and is adjacent to the exhaust nozzle travels with the rocket or missile. Upon such separation when the rocket is launched from the pad and the connector assembly is separated, an interior portion of the connector assembly is now exposed. The front face plate of that interior portion is known as the deadface. In this application, when the connector assembly is separated and the deadface is exposed, the deadface is located adjacent to the exhausts coming from the rocket nozzle and therefore, subjected to extreme high temperatures in the range of 3,000° to 5,000° Fahrenheit. It is an object of the present invention to have an improved ceramic deadface on the connector assembly which is able to withstand exposure to extreme high temperatures in the range of 3,000° to 5,000° Fahrenheit so that the internal components housed within the connector assembly which travel with the rocket or missile are not damaged by the exposure to extreme high temperatures.

It is also another object of the present invention to provide an improved ceramic deadface on a connector assembly which can be fitted within the ordinary physical size requirements of an ordinary connector assembly used in the connection of electronic male and female plugs and wires from a ground based computer system to an onboard computer system and which can be machined to have a multiplicity of openings extending therethrough so that the plugs and connectors can be fitted through the openings of the improved ceramic deadface while at the same time providing an appropriate shield to protect the components once the rocket or missile is launched and the components are exposed to extreme heat from the rocket exhaust.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Described briefly, the present invention is an improved connector assembly which is designed to connect electronic components from a ground based system which, by way of example, can be a computer system, to a second system located at a remote location which, by way of example, can be another computer system set within the housing of a rocket or missile. The electronic components include male and female connector assemblies and wires and other components conventionally used to connect one electronic component on a ground based system to another electronic component at a remote location. What is novel about the present invention connector assembly is that it is located adjacent to a source of extreme heat which, by way of example, can be the exhaust nozzle from a rocket or missile and upon launch, the connector assembly is caused to separate so that a portion of the connector assembly which is directly connected to the in-house electronic means which, by way of example, can be a programing computer, is caused to remain on the ground while the other half of the connector assembly which is attached to the missile or rocket and which connects the wires that go to the onboard computer or other electronic system, is launched with the rocket. At the point of disconnection, the internal portion of the connector assembly which is located adjacent to the exhaust heat from the rocket is exposed to extremely high temperatures such as 3,000° to 5,000° Fahrenheit and the front face plate of the internal portion of the connector assembly so exposed upon disconnection is made of the improved present invention ceramic deadface which is designed to withstand the exposure to such extreme heat and prevent the internal components of the connector assembly from being damaged or melted.

Figure 1:
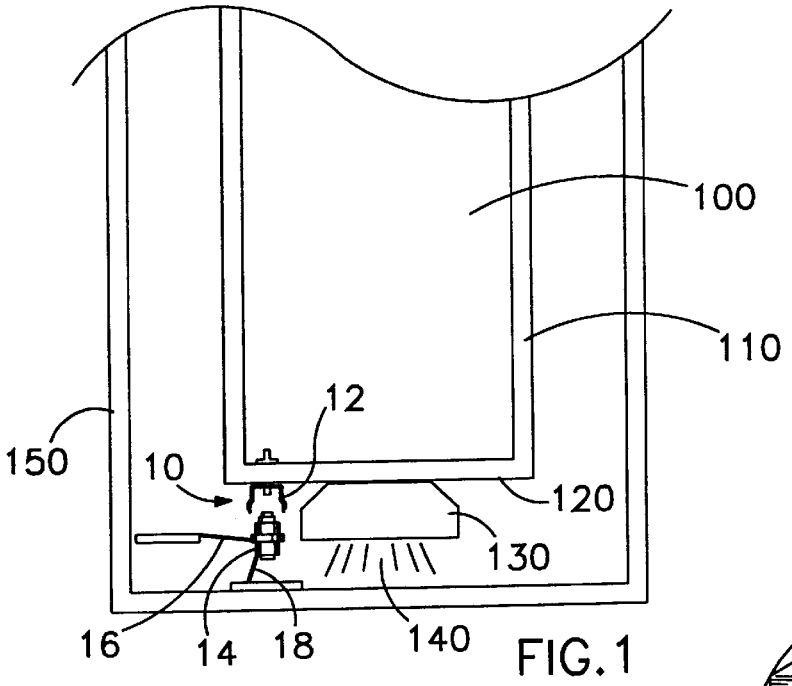
FIG. 1 is a perspective view of a lower portion of a rocket or missile with the present invention improved connector assembly with the extreme temperature protective ceramic deadface, located adjacent to the exhaust cone of the missile or rocket and also showing the portion of the present invention connector assembly being disengaged from the rocket as it is taking off and thereby exposing the deadface to the extreme heat of the rocket exhaust.

Referring to FIG. 1, there is shown a cross-sectional view of the lower portion of a rocket or missile 100 which contains an outer missile casing 110 and a lower flat face 120. Attached to the lower flat face of the missile or rocket is the exhaust cone 130 from which exhaust flames 140 emanate upon launch. Attached to the lower portion of the missile on its flat face 120 is a connector assembly 10 which comprises a multiplicity of components which include the present invention ceramic deadface. The illustration shown in FIG. 1 shows that the connector assembly.10 can be disconnected into two sections, an upper section 12 which is affixed to the missile 100 and will leave the launch pad with the missile once it is launched and a lower section 14 which is connected by lanyards made of steel to the ground so that it remains on the ground as it separates from the upper section 12 upon launch. The lower section 14 of the connector assembly 10 is attached to the ground by means of steel cables 16 and 18 which are attached to the tower 150 located adjacent to the rocket or alternatively, to a missile silo 150 in which the missile is housed before it is launched. As is illustrated from the cross-sectional view of the connector assembly in FIG. 1, the lower section 14 of the connector assembly 10 which remains on the ground includes a lanyard 18 which can be separated from the upper section 12 of the connector assembly 10 without damage. The contact pins 28 (see FIG. 5) are in turn connected to wires and other electronic connection means which in turn are connected to a land based electronic system which, by way of example, can be a computer programming system. It is noted that these contact pins 28 must extend through the internal face of the connector assembly 10 in order to be attached to contact pins and connecting wires which are located in the upper section 12 of the connector assembly 10 and in turn are caused to lead to the internal electronic means which, by way of example, can be an onboard computer.

Figure 2:
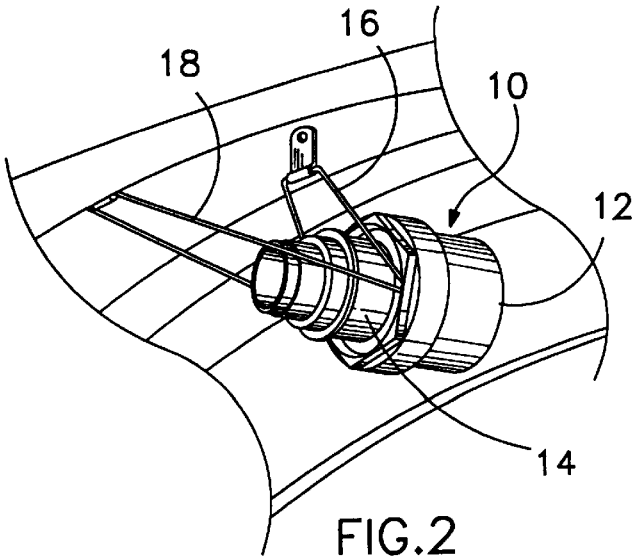
FIG. 2 is a perspective view of the lower portion of the connector assembly showing how it is retained on a ground based support system inside a missile silo or rocket tower with lanyards retaining the lower portion of the connector assembly on the ground after the missile or rocket has been launched from its missile silo or from its rocket pad; 16

Referring to FIG. 2, there is shown in greater detail a perspective view of the entire connector assembly 10 assembled and attached to the missile silo or rocket launch housing 150. The steel lanyards 16 and 18 are shown connected to various locations of the missile silo. It can be noted from both FIGS. 1 and 2 that one of the lanyards attaches the connector assembly to the lower base portion of the rocket housing or missile silo while another of the lanyards attaches the lower portion of the connector assembly to the sidewall of the missile silo so that the connector assembly remains fixed and is not caused to in any way interfere with the missile or rocket launch. While the contact pins 28 of the connector assembly 10 may be exposed to the high temperatures and may be destroyed, the lower section 14 of the connector assembly 10 can be easily replaced and it is the upper section 12 of the connector assembly 10 which leaves with the missile or rocket that needs to be protected from the extreme high temperatures so that the wire connections and other electronic means connecting the upper section 12 of the connector assembly 10 to the electronic means on the rocket or missile which, by way of example, can be an onboard computer, are not damaged.

Figure 3:
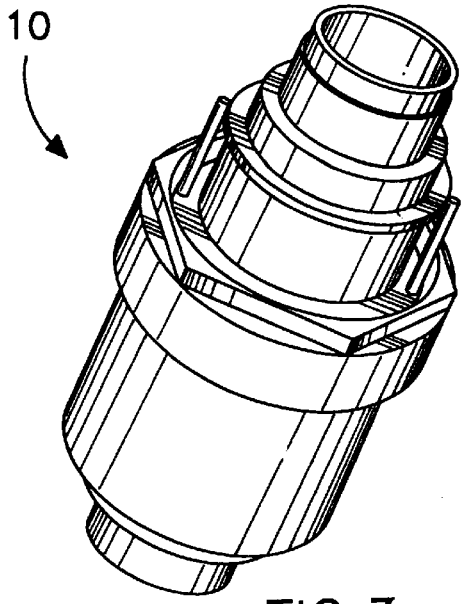
FIG. 3 is a perspective view of a fully assembled connector assembly which contains the improved ceramic deadface within it.

Referring to FIG. 3, there is shown a complete perspective view of the connector assembly 10 which contains the internal improved ceramic deadface as well as other conventional components in a connector assembly.

Figure 4A:
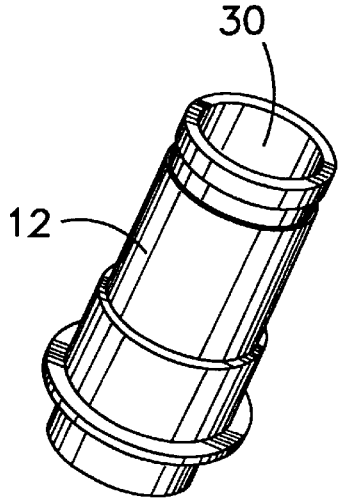
FIG. 4*a* is a perspective view of the internal portion of the connector showing the improved ceramic deadface exposed.

Referring to FIG. 4*a*, there is shown an exterior perspective view of a portion of the internal upper section 12 of the connector assembly 10 which includes the improved present invention deadface 30.

Figure 4B:
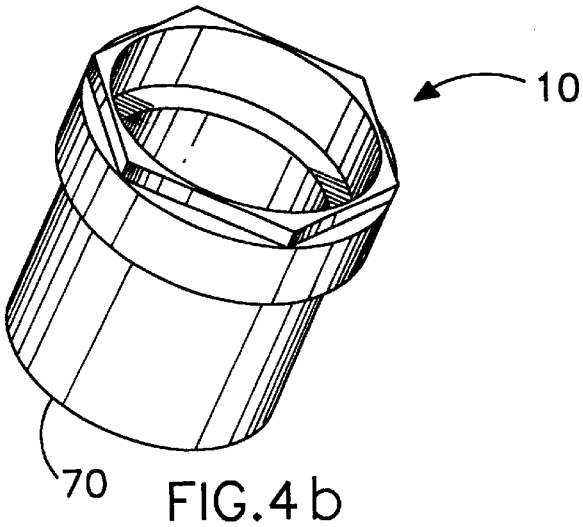
FIG. 4*b* is a perspective view of the external steel jam nut which also serves to protect the internal components.

Referring to FIG. 4*b*, there is shown the exterior perspective view of the shell or jam nut which is designed to shield the exterior portion of the upper section 12 of the connector assembly 10. It is listed as reference number 70 and can be made of stainless steel.

Figure 5:
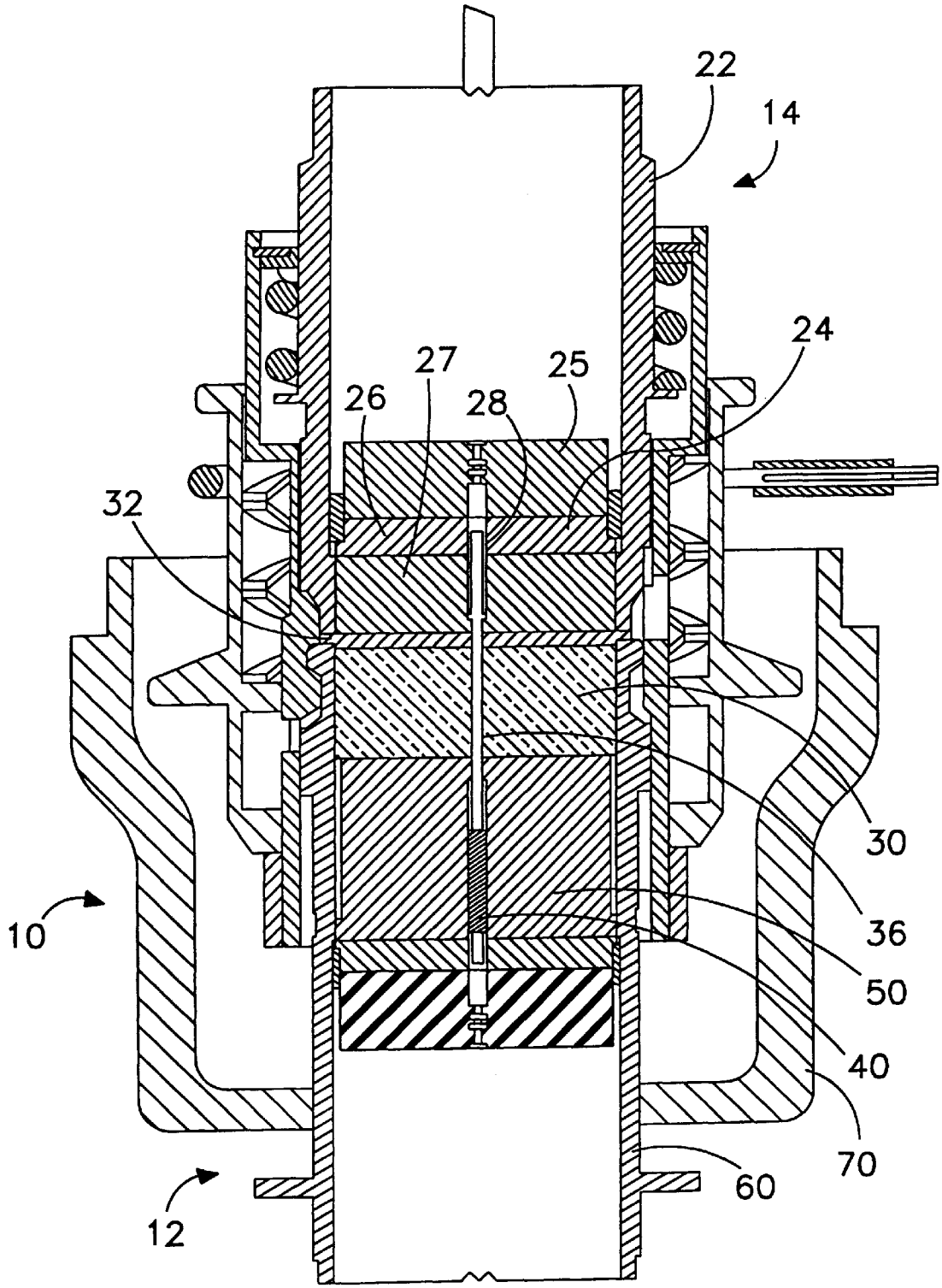
FIG. 5 is a cross-sectional view of the connector assembly showing the components of the connector assembly including the improved ceramic deadface.

Referring to FIG. 5, there is shown a cross-sectional view of the present invention connector assembly 10. The lower section 14 on the connector assembly 10 comprises a plug housing 22 and an insert assembly 24 which in turn comprises several sections of plugs which can be made of various materials including metal, polymers, fiber reinforced polymers, or other materials that are conventionally used for internal space filling and structural support in a connector assembly. These are specifically numbered Parts 25, 26 and 27. It is noted that each of these parts has drilled through it an opening. FIG. 5 is by way of illustration only to show one opening extending through the insert assembly 24 and it will be appreciated that there will be a multiplicity of such openings extending through the insert assembly to accommodate a multiplicity of contact pins 28. The contact pins 28 are conventionally made out of beryllium copper or other suitable connection materials. The contact pins 28 are in turn connected to wires and other electronic means which in turn are connected to a land based electronic system which, by way of example, can be a computer or other electronic programming means. The location of disconnection of the lower section 14 of the connector assembly 10 from the upper section 12 of the connector assembly 10 is illustrated at location 32. Upon launch of the missile or rocket, the lower section 14 of the connector assembly 10 just described remains on the ground as illustrated in FIG. 1 and is retained on the missile silo or structure adjacent to the rocket by the steel lanyards 16 and 18 previously discussed. Once the connector assembly 10 is disconnected upon launch, the internal lowermost area of the upper section 12 of the connector assembly 10 faces the ground and is exposed adjacent the exhaust cone 130 and the heat flames 140 from the missile exhaust. The outermost exposed internal portion of the connector assembly 10 then comprises the present invention deadface 30. It will be appreciated that the contact pins are shown extending through the present invention deadface 30 through openings 36 and connecting with a female socket 40. The female socket 40 in turn is housed within an upper connector assembly insert 50 which also can be made of various materials such as metal, plastic, polymers or fiber reinforced polymers. The female socket 40 of the connection is further attached to various wires and other electronic means which in turn lead to the onboard electronic system which, by way of example, can be an onboard computer. The present invention deadface 30, the additional insert assembly 50 and the female socket 40 are all housed within the external metal cylinder 60 of the upper section 12 of the connector assembly 10. Also surrounding the upper section 12 of the connector assembly 10 is a steel metal jam nut 70 which is also made of stainless steel and as illustrated in FIG. 1, and further serves to shield the exterior of the connector assembly 10 from the heat exhaust of the missile or rocket.

Figure 6:
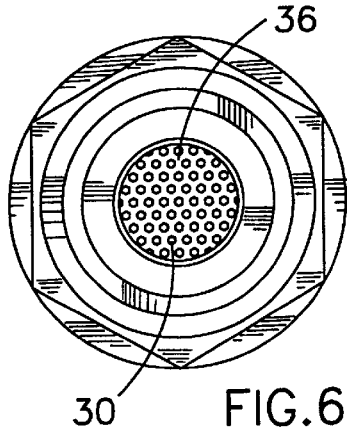
FIG. 6 is a top plan view looking into the connector assembly with portions removed to show the deadface with a multiplicity of holes machined into it to accommodate male connector plugs and wires.

Referring to FIG. 6 there is shown a top plan view of the internal components of the upper section 12 of the connector assembly 10. In particular, the present invention ceramic deadface 30 is illustrated with a multiplicity of openings 36 to show that the present invention ceramic deadface can be machined to accommodate a multiplicity of openings to permit the contact pins 28 to extend therethrough and come into contact with respective contact female sockets 40.

By way of example, the diameter of the deadface 30 which is shown as circular in FIG. 6 is approximately one inch although other suitable diameters to accommodate connectors of various sizes are certainly within the spirit and scope of the present invention. The thickness of the deadface assembly can be anywhere from ¼" to 1". The openings 36 drilled through the deadface 30 can be several millimeters or several fractions of an inch in diameter. The improved ceramic deadface 30 is made out of alumina powder and/or alumina based ceramic which is not fully cured. By way of example, the improved ceramic deadface 30 can be comparable to a deadface manufactured by Coors AD-998-SI Ceramic(Bisque).

Through tests it has been shown that the ceramic deadface 30 made out of powder based alumina ceramic which is not fully cured can withstand temperatures in the range of 3,000° to 5,000° Fahrenheit which is the types of temperatures that are achieved from the missile or rocket launch exhaust upon takeoff or launch. The present invention enables the internal guts of the connector assembly which are attached to the rocket or missile to be protected and preserved and the deadface 30 made out of alumina powder based ceramic which is not fully cured protects the internal female connections and wires and other components and prevents them from being melted or otherwise damaged which would in turn damage the onboard computer or other electronic system to which they are connected. Further, the external steel jam nut 70 also serves to facilitate protection of the internal components from the extreme heat. By way of example, the jam nut which serves as a flame shield can be made out of 303 stainless steel which can be ¼" thick. Further, the housing of the connector assembly 60 can also be made out of stainless steel which, by way of example, can also be 303 stainless steel which is ⅛" thick.

Defined in detail, the present invention is a connector assembly located adjacent the exhaust cone of a missile and having two sections, a first section affixed to a structure on the ground so that it is retained on the ground after the missile is launched and a second section connected to the missile so that it travels with the missile after the missile is launched, the connector assembly used to connect electronic components from a ground based computer system to a second computer system located at a location on the missile wherein the connector assembly is separated into two sections when the missile is launched, with the first section of the connector assembly including a plug housing, an insert assembly having several sections of plugs with holes to accommodate respective contact pins connected at one end to the ground based computer system and connected at their other ends to female socket members which are housed in connector inserts located in the second section within the connector assembly and which female socket members are in turn connected to wires which are connected to the second computer system on the missile, the connector assembly comprising: (a) a deadface housed within the second section of the connector assembly and located between the connector insert within the second section and the adjacent insert plug of the first section; (b) the deadface having a multiplicity of openings extending through the thickness of the deadface to accommodate a respective one of the multiplicity of connector pins; and (c) the deadface made out of alumina powder based ceramic which is not fully cured and can withstand temperatures in the range between 3,000° Fahrenheit and 5,000° Fahrenheit; (d) whereby when the missile is launched, the deadface is the portion of the connector assembly attached to the missile which is exposed to the heat of the missile exhaust and thereby prevents the remaining components in the second section of the connector assembly from being damaged by the missile exhaust.

Defined broadly, the present invention is a connector assembly located adjacent a source of high heat, the connector assembly having two sections which are caused to separate so that each of the two sections are exposed to the high heat, at least one section of the connector assembly having electronic components and the at least one section of the connector assembly comprising: (a) a deadface housed within the at least one section of the connector assembly so that it is exposed to the high heat when the connector assembly is separated into the two sections and is located between the high heat and the electronic components housed within the at least one section of the connector assembly; and (b) the deadface made out of alumina powder based ceramic which is not fully cured and can withstand temperatures in the range between 3,000° Fahrenheit and 5,000° Fahrenheit; (c) whereby when the connector assembly is separated, the deadface is the portion of the at least one section of the connector assembly which is exposed to the high heat and thereby prevents the electronic components in the at least one section of the connector assembly from being damaged by the high heat.

Defined more broadly, the present invention is a connector assembly located adjacent a source of high heat, the connector assembly having two sections which are caused to separate so that each of the two sections are exposed to the high heat, at least one section of the connector assembly having components and the at least one section of the connector assembly comprising: (a) a deadface housed within the at least one section of the connector assembly so that it is exposed to the high heat when the connector assembly is separated into the two sections and is located between the high heat and the components housed within the at least one section of the connector assembly; and (b) the deadface made out of alumina powder based ceramic which is not fully cured so that it can withstand temperatures in the range between 3,000° Fahrenheit and 5,000° Fahrenheit; (c) whereby when the connector assembly is separated, the deadface is the portion of the at least one section of the connector assembly which is exposed to the high heat and thereby prevents the components in the at least one section of the connector assembly from being damaged by the high heat.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A connector assembly located adjacent to the exhaust cone of a missile and having two sections, a first section affixed to a structure on the ground so that it is retained on the ground after the missile is launched and a second section connected to the missile so that it travels with the missile after the missile is launched, the connector assembly used to connect electronic components from a ground based computer system to a second computer system located at a location on the missile wherein the connector assembly is separated into two sections when the missile is launched, with the first section of the connector assembly including a plug housing, an insert assembly having several sections of plugs with holes to accommodate respective contact pins connected at one end to the ground based computer system and connected at their other ends to female socket members which are housed in connector inserts located in the second section within the connector assembly and which female socket members are in turn connected to wires which are connected to the second computer system on the missile, the connector assembly comprising:

a. a deadface housed within the second section of the connector assembly and located between the connector insert within the second section and the adjacent insert plug of the first section;

b. the deadface having a multiplicity of openings extending through the thickness of the deadface to accommodate a respective one of said multiplicity of connector pins; and c. the deadface made out of alumina powder based ceramic which is not fully cured and can withstand temperatures in the range between 3,000° Fahrenheit and 5,000° Fahrenheit;

d. whereby when said missile is launched, the deadface is the portion of the connector assembly attached to the missile which is exposed to the heat of the missile exhaust and thereby prevents the remaining components in the second section of the connector assembly from being damaged by the missile exhaust.

2. The connector assembly in accordance with claim 1 wherein the deadface is between approximately ¼ inch thick and approximately 1 inch thick.

3. The connector assembly in accordance with claim 1 wherein the openings in the deadface are each several millimeters in diameter.

4. A connector assembly located adjacent to a source of high heat, the connector assembly having two sections which are caused to separate so that each of the two sections are exposed to the high heat, at least one section of the connector assembly having electronic components and the at least one section of the connector assembly comprising:

a. a deadface housed within the at least one section of the connector assembly so that it is exposed to the high heat when the connector assembly is separated into the two sections and is located between the high heat and the electronic components housed within the at least one section of the connector assembly; and b. the deadface made out of alumina powder based ceramic which is not fully cured and can withstand temperatures in the range between 3,000° Fahrenheit and 5,000° Fahrenheit;

c. whereby when the connector assembly is separated, the deadface is the portion of the at least one section of the connector assembly which is exposed to the high heat and thereby prevents the electronic components in the at least one section of the connector assembly from being damaged by the high heat.

5. The connector assembly in accordance with claim 4 wherein the deadface is between approximately ¼ inch thick and approximately 1 inch thick.

6. The connector assembly in accordance with claim 4 wherein the deadface has a multiplicity of openings extending through the thickness of the deadface to accommodate portions of the electronic components.

7. The connector assembly in accordance with claim 6 wherein the openings in the deadface are each several millimeters in diameter.

8. A connector assembly located adjacent to a source of high heat, the connector assembly having two sections which are caused to separate so that each of the two sections are exposed to the high heat, at least one section of the connector assembly having components and the at least one section of the connector assembly comprising:

a. a deadface housed within the at least one section of the connector assembly so that it is exposed to the high heat when the connector assembly is separated into the two sections and is located between the high heat and the components housed within the at least one section of the connector assembly; and b. the deadface made out of alumina powder based ceramic which is not fully cured and can withstand temperatures in the range between 3,000° Fahrenheit and 5,000° Fahrenheit;

c. whereby when the connector assembly is separated, the deadface is the portion of the at least one section of the connector assembly which is exposed to the high heat and thereby prevents the components in the at least one section of the connector assembly from being damaged by the high heat.

9. The connector assembly in accordance with claim 8 wherein the deadface is between approximately ¼ inch thick and approximately 1 inch thick.

10. The connector assembly in accordance with claim 8 wherein the deadface has a multiplicity of openings extending through the thickness of the deadface to accommodate portions of the components.

11. The connector assembly in accordance with claim 10 wherein said multiplicity of openings in the deadface are each several millimeters in diameter.

* * * * *